United States Patent [19]

Woods

[11] Patent Number: 4,475,532

[45] Date of Patent: Oct. 9, 1984

[54] COMBINED HEATER STOOL AND CARRYING CASE

[76] Inventor: Cecil M. Woods, 3351 S. 7700 West, Magna, Utah 84044

[21] Appl. No.: 504,756

[22] Filed: Jun. 15, 1983

[51] Int. Cl.[3] ..... A61F 7/08

[52] U.S. Cl. ..... 126/204; 126/206

[58] Field of Search ..... 126/204, 206, 208, 59, 126/59.5, 262, 225; 219/217, 527; 165/185; 220/3.1

[56] References Cited

U.S. PATENT DOCUMENTS

| | | | |
|---|---|---|---|
| 54,808 | 5/1866 | Wright | 126/208 |
| 567,166 | 9/1896 | Rickard et al. | 126/206 |
| 787,403 | 4/1905 | Sanders | 126/206 |
| 2,488,014 | 11/1949 | Higman | 126/59 |
| 2,829,635 | 4/1958 | Teller | 126/208 |
| 2,904,031 | 9/1959 | Scott | 126/204 |
| 3,093,129 | 6/1963 | Pickard, Jr. | 126/65 |
| 3,263,671 | 8/1966 | Filliol | 126/59.5 |
| 4,351,314 | 9/1982 | Morton | 126/59 |

FOREIGN PATENT DOCUMENTS

| | | | |
|---|---|---|---|
| 64598 | 1/1892 | Fed. Rep. of Germany | 126/206 |
| 19131 | of 1911 | United Kingdom | 126/204 |

*Primary Examiner*—Randall L. Green

*Attorney, Agent, or Firm*—Henderson & Sturm

[57] ABSTRACT

This invention relates to portable duck blind stools in general, and more specifically to a heated stool construction that can be inverted to serve as a carrying case for transporting articles to and from a duck blind, and which is further provided with a securable lid member having a plurality of closed fuel receptacles attached thereto, to create a heat source for the stool proper.

9 Claims, 5 Drawing Figures

COMBINED HEATER STOOL AND CARRYING CASE

BACKGROUND OF THE INVENTION

As any avid waterfoul hunter is aware, the best days for gunning ducks and geese are usually the worst days for humans. Ideal weather conditions usually require rain and/or snow, wind, and cold temperatures. These factors normally combine to create an environment that is something less than ideal, particularly when you consider the fact that most hunters are exposed to these conditions for prolonged periods of time, in their quest for their feathered quarry.

In order to alleviate the chill, experienced by even heavily garbed hunters, after several hours in a duck blind or goose pit, quite a few hunters have resorted to using portable heaters. While this type of a device will obviously produce the requisite warmth, the primary objections that most hunters have with regard to them are that; they are heavy or cumbersome; serve only on function; occupy a lot of space in an environment where space is normally at a premium; and require a separate fuel supply in liquid or solid form.

Some examples of prior art portable heaters may be seen by reference to the following U.S. Pat. Nos.: 2,488,014; 3,093,120; 3,263,671 and 4,351,314. None of the aforementioned patents is intended, designed, nor adaptable for use as a heated stool that is capable, not only of providing a warm, comfortable, seating surface, but which is also designed to function as a carrying receptacle for miscellaneous items not involved with the heating feature.

SUMMARY OF THE INVENTION

An object of the present invention is to provide a device that will function as a carrying case.

Another object of the present invention is to provide a device that will also function as a portable heater.

Still another object of the present invention is to provide a device that will also function as a stool.

Yet another object of the present invention is to provide a combined function device, that serves as a carrying case in one vertical orientation, and as a heated stool in another vertical orientation.

A further object of the present invention is the provision of a large volume article carrying case, wherein the lid portion is provided with a plurality of fuel receptacles, which are ignited to create a heated stool after the articles have been removed.

These and other objects, advantages and novel features of the invention will become apparent from the detailed description that follows, when considered in conjunction with the accompanying drawings.

DETAILED DESCRIPTION OF THE PREFERRED EMBODIMENT

Figure 1:
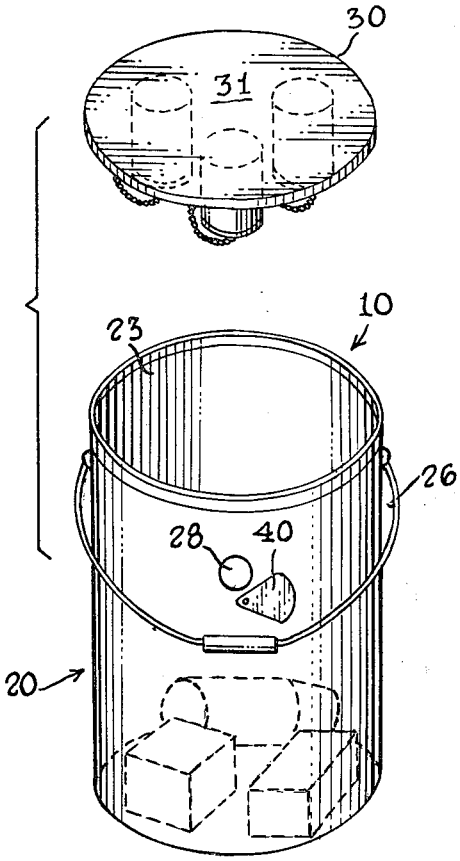
FIG. 1, is an exploded perspective view of the device in its inverted mode used as a carrying case, to transport items to and from the blind.

As can be seen by reference to FIG. 1, the combined heater, stool, and carrying case of the present invention is designated generally as 10, and comprises an elongated generally cylindrical metal receptacle member 20, and a lid member 30.

Figure 2:
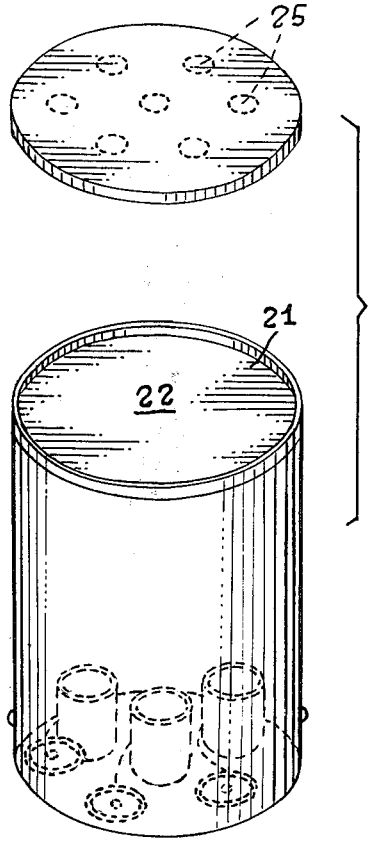
FIG. 2, is an exploded perspective view of the device in its upright mode used as a heated stool.

As can best be seen in FIG. 2, the elongated receptacle member 20 is provided with a shallow recess 21 on the exterior surface of its closed end 22; and the dimension of the closed end, is such as to provide an ample seating surface for an adult.

A thin resilient seat pad element 24 is also provided, which is dimensioned to fit within the shallow recess, and cover the closed end 22 of the receptacle. In one form of the invention, the seat pad 24 may optionally be provided with a plurality of apertures 25 (shown in phantom), whose purpose and function are to allow more heat to be transmitted to the user.

In addition to the above mentioned structural elements, the receptacle member 20 is further provided with a handle element 26, pivotally disposed on opposite sides of the receptacle, proximate its open end 23, and an adjustable damper element 40, which cooperates with a single enlarged damper aperture 28 disposed proximate to, but spaced from, the open end of the receptacle member 20.

Figure 4:
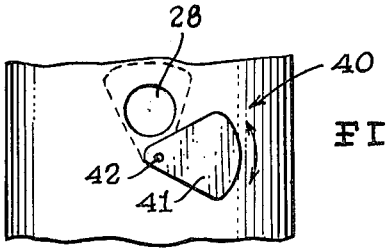
FIG. 4, is a detail view of one form of adjustable damper used in the device.

In one form of the preferred embodiment illustrated in FIG. 4, the damper element 40 comprises a disk 41 that is pivotally secured to the receptacle 20 by pivot means 42 disposed proximate the single enlarged damper aperture 28; wherein the the disk 41 may be selectively rotated, to cover a portion or all of the damper opening 28.

Figure 5:
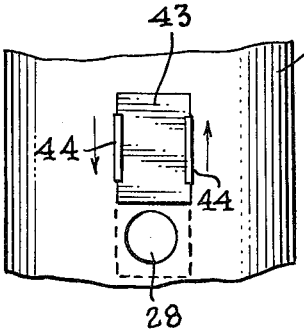
FIG. 5, is a detail view of another form of adjustable damper used in the device.

In another form of the preferred embodiment illustrated in FIG. 5, the damper element 40 comprises an elongated, generally rectangular damper plate 43, that is frictionally and slidingly engaged by a pair of elongated retaining members 44, disposed on opposite sides of the single damper aperture 28, wherein the damper plate may be selectively moved to progressively cover or ultimately block off the aperture opening.

It should be appreciated at this point, that in both of the aforementioned forms of the preferred embodiment, the damper element 40 is adapted to completely seal off the passage of air through the damper aperture 28, when the damper element 40 is in the position indicated by the phantom lines in FIGS. 4 and 5 respectively. This may be accomplished by the use of a rubber gasket (not shown) or other resilient sealing means disposed intermediate the damper element and the side of the receptacle member 20.

Figure 3:
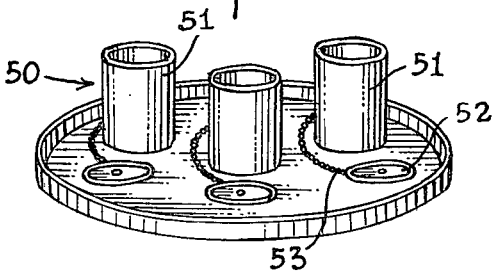
FIG. 3, is a detail view of the lid member and plurality of fuel receptacles.

The lid member 30 illustrated in FIGS. 1 and 3, comprises a flat cylindrical lid element 31, which is adapted to sealingly engage the open end 23 of the enlarged receptacle 20 in a generally snap-fit, or frictionally snug, relationship. The sealing engagement of the lid member 30 and the receptacle member 20; not only keeps the miscellaneous articles contained within the device 10 dry, when the device is being used as a carrying case; but also forms a sealed receptacle that will deprive the combustion process of oxygen, when it is desired to terminate the heater function of the device 10.

As can best be seen by reference to FIG. 3, the heat producing means 50 for the device 10 comprises a plurality of fuel cylinders 51 that are rigidly secured to the underside of the lid member 30. Each of the fuel cylinders 51 is further provided with a cap member 52, that is adapted to sealingly engage the open end of the cylinders 51, and flexible retaining means 53 that maintain the cap members adjacent to their respective cylinders, when they are not disposed in sealing engagement therewith. The flexible retaining means 53 are preferably in the form of a length of chain, that may be attached to the underside of the lid member 30, or directly to the fuel cylinders themselves.

Since it is desirable to produce the maximum amount of heat with the least amount of muss and fuss, gel type or paraffin based fuels are recommended for use in the fuel cylinders. Not only are these fuels relatively inexpensive, but they also exhibit the desired property of tending to solidify at temperatures below 50° F. This shared characteristic makes it extremely unlikely that any of the fuel will leak from the cylinders, when the device 10 is inverted to function as an article carrying case.

Obviously since sandwiches and other food items will be transported to the blind in this device, it is imperative that relatively solid fuels and secure cap members are employed. While contamination of foodstuffs is one consideration, the primary reason that a plurality of fuel cylinders are employed, as opposed to a single large fuel cylinder, is so that the heat generated within the stool can be controlled in a safe, simple, and efficient manner.

The function and operation of the device 10 proceeds as follows. The hunter places his shotgun sheels, thermos, food, calls, etc., into the receptacle member 20, and secures the lid member 30 in place. He then grasps the handle 26 and transports the aforementioned items to the duck blind in a waterproof container. Once in the blind the articles are removed, and depending on how cold the day is, one or more of the fuel cylinders are ignited. The receptacle member is inverted and placed over the lid member so that the device is once again sealed, and the flow of oxygen into the interior, to maintain and regulate combustion, can be accomplished by the selective manipulation of the single damper element 40.

If for some reason the heat generated by the cylinders is excessive or insufficient; it is a simple matter to cause combustion to cease, by simply closing off the damper. The receptacle member is then removed, and the proper number of fuel cylinders may then be re-ignited.

The invention to this point has been described as to its basic components and broad functional design; however, the device 10 is not quite as simple as it might initially be perceived. First of all, by providing a plurality of fuel cylinders, a large volume of fuel can be stored, and selectively ignited, a substantial distance from the seat portion of the device. In fact the tops of the fuel cylinders in the preferred embodiment will extend into the receptacle member a maximum of one third of the depth of the receptacle. This not only insures that the user should not be exposed to excessively high temperatures, but also provides a large carrying capacity for the other articles mentioned supra.

In addition, the single damper aperture is disposed at the same level as the tops of the fuel cylinders (i.e., approximately a third of the way down the side of the receptacle member 20). The reasons for the positioning of the aperture 28, and the fact that only a single aperture is employed, are as follows. Since heat rises, the maximum amount of heat will be retained, by positioning the aperture as far away from the seat surface as possible. Positioning the aperture, at approximately the same height as the tops of the fuel cylinders, allows the effects of the progressive closing of the damper to be observed. Providing only a single aperture, not only insures that the heater can be positioned such that any smoke or fumes will exist from the receptacle on the downwind side; but also makes it easier to fabricate the damper so that the closed receptacle is not only watertight, but air tight as well. This latter feature is particularly significant to hunters that gun from water blinds; in as much as the carrying case can also function as a life preserver in an emergency.

Having thereby described the subject matter of this invention it should be obvious that many substitutions, modifications and variations are possible in light of the above teachings. It is therefore to be understood that the invention as taught and described is only to be limited as to the breadth and scope of the accompanying claims.

What I claim is:

1. A combined heater, stool, and carrying case wherein the device comprises:

an elongated receptacle member having an open end with a handle element disposed proximate thereto, and a shallow recess formed in the closed end of the receptacle member, and a lid member adapted to sealingly engage the open end of the elongated receptacle member, and further provided with a heat producing means secured to the underside of the lid element, wherein the heat producing means comprises at least one fuel cylinder having a cap member operatively connected thereto via a flexible retaining means.

2. A device as in claim 1; wherein, the heat producing means comprises a plurality of fuel cylinders, which are provided with cap members that are operatively connected thereto, via flexible retaining means.

3. A device as in claim 2; wherein, the elongated receptacle is provided with a damper aperture disposed proximate to, but spaced from, the open end of the said receptacle.

4. A device as in claim 3; wherein, a damper element is moveably disposed adjacent to the damper aperture, and adapted to sealingly engage the surface of the receptacle surrounding the aperture.

5. A device as in claim 1; wherein, the shallow recess formed in the closed end of the receptacle is further provided with a seat pad element.

6. A device as in claim 4 wherein the fuel cylinders are dimensioned such that they will extend up to a third of the depth of the receptacle when the lid member is in place.

7. A device as in claim 6; wherein, the damper aperture is disposed at approximately the same level as the tops of the fuel cylinder when the lid is in place.

8. A device as in claim 7; wherein, the damper element is pivotally disposed with respect to the damper actuator.

9. A device as in claim 7; wherein, the damper element is slidingly disposed with respect to the damper aperture.

* * * * *